United States Patent [19]

Bookspan

[11] Patent Number: 5,029,856

[45] Date of Patent: Jul. 9, 1991

[54] GOLF CUP FOR ARTIFICIAL GREENS

[76] Inventor: Irving W. Bookspan, 3051 Sagan, Oakland, Calif. 94601

[21] Appl. No.: 629,247

[22] Filed: Dec. 17, 1990

[51] Int. Cl.[5] ..... A63B 57/00

[52] U.S. Cl. ..... 273/34 R; 273/DIG. 8

[58] Field of Search ..... 273/34 R, 34 A, 34 B, 273/178 R, 178 A, 178 B, 180, 177 B

[56] References Cited

U.S. PATENT DOCUMENTS 1,840,038 1/1932 Jones et al. ..... 273/34 R

FOREIGN PATENT DOCUMENTS 23425 7/1936 Australia ..... 273/34 R

*Primary Examiner*—George J. Marlo

*Attorney, Agent, or Firm*—Bruce & McCoy

[57] ABSTRACT

A golf cup for artificial greens comprising a golf cup having a cylindrical layer of a compressible substance secured to the upper internal end of the golf cup which extends for a portion of the internal length of the cup from the upper end thereof.

4 Claims, 2 Drawing Sheets

GOLF CUP FOR ARTIFICIAL GREENS

BACKGROUND OF THE INVENTION

1. FIELD OF THE INVENTION

The present invention relates to golf cups for artificial golf greens, and more particularly, to a golf cup for use with a sand/granulate filled turf whereby the play action of a bent grass golf green cup is replicated in a golf cup for a simulated bent grass golf green surface for true golf play.

2. DESCRIPTION OF THE PRIOR ART

Natural grass golf greens are preferably made with bent grass which has a very distinct and desired playing character. The golf cups which are inserted into a bent grass green have their top edges recessed below the surface of the green in the golf hole whereby, as a golf ball is putted toward the hole with more force than is required for the ball to just drop in the hole, the ball bounces against the opposite side of the hole. It hits either the grass layer or the earth-grass root transition area below the grass layer, or the exposed earth below the transition area, to either drop in the cup or possibly bounce out due to its momentum, spin rate, and the vertical location it strikes the opposite side of the hole from its direction of entry.

In an effort to reduce the expense of golf green maintenance and to eliminate the problems which often occur in golf greens such as burning (dead grass), localized loss of the grass, irregular surfaces, pocking by golf balls and footprints, and even intentional destruction, golf course owners have come to accept artificial golf greens such as Tour-True TM produced by U.S. Indoor Golf of San Francisco, Ca., as a substitute for real grass. This product simulates a bent grass golf green and replicates the play of natural grass but yet is close to maintenance free. The Tour-True TM surface, in particular, consists of a durable polypropylene carpet fiber and a shock absorbent felt-like underpad. The carpet fiber is filled with a formulated, noncompactable, granular dressing which provides a surface that putts true like a real bent grass green. The speed of an artificial green such as Tour-True TM can be adjusted by varying the amount of top dressing. Such greens can be used indoors or outdoors and particularly for putting greens, target greens, putting courses, miniature golf, and even for landscape use. In outdoor applications, the artificial green maintains a consistent surface under all "playable" weather conditions.

One problem with these artificial greens has been due to the fact that the simulated surface is not the same as real earth or grass immediately below the playing surface. When the golf hole is cut in an artificial green, the sand particulate or granular dressing in the carpet fiber surrounding the hole tends to fall into the hole and the carpet fibers surrounding the hole then tend to bend over toward the hole causing an increasing depression in the green immediately surrounding the hole. In order to prevent this breakdown of the lip of the hole, it is necessary to seat the golf cup in the hole at a much higher position in the hole than in a real grass green in order to support the carpet fibers and top dressing surrounding the hole and prevent the deterioration of the lip of the hole. The cup is arranged to fit about 1/8 to 3/16 of an inch below the tips of the upstanding fibers adjacent the hole. As a result, the inside of the golf hole has a hard liner immediately below the playing surface. It is not comparable to the grass-earth transition area disposed above the cup rim in a real grass green whereby the play of a hole located in a real bent grass golf green has not been accurately replicated. It has not been until the development of the present invention through trial and error that the property of true play, the same as a natural bent grass golf hole, is replicated when a ball is putted into the improved golf cup of a simulated bent grass green.

SUMMARY OF THE INVENTION

The present invention is a golf cup for an artificial or simulated grass golf green, and particularly, for a sand/-granulate filled turf used as a golf green. It includes a golf cup insert which is essentially a hollow cylinder with a partially closed bottom to catch golf balls. The insert has a cylindrical layer of a compressible rubberized substance secured to the upper internal end of the golf cup insert which extends for a portion of the length of the internal surface of the upper end thereof. The cylindrical layer has an internal diameter equal to the internal diameter of a standard golf green hole. This upper end of the insert is formed to be disposed substantially level with the commencement of the base dressing in the artificial green surface.

OBJECTS OF THE INVENTION

It is therefore an important object of the present invention to provide a golf cup for an artificial golf green which plays like a golf cup disposed in a real bent grass golf green.

It is another object of the present invention to provide a golf cup for an artificial golf green in which the upper end of the cup is disposed in operative position close to the top of the hole just below the playing surface of the artificial green for the purpose of providing a true bounce surface on the inside of the hole which replicates play of a golf ball striking the grass root earth interface below the surface of a bent grass green when a golf ball is stroked into the golf cup of the artificial green.

It is a further object of the present invention to provide a golf cup for an artificial golf green which utilizes a standard golf cup made for real grass greens with an upper end adapter that allows the standard golf cup to be adapted for use with artificial greens and provides real grass green play to golf balls putted into the artificial green golf cup in all playable weather.

Other objects and advantages of the present invention will become apparent when the apparatus of the present invention is considered in conjunction with the accompanying drawings.

DESCRIPTION OF THE PREFERRED EMBODIMENT

Reference is made to the drawings for a description of the preferred embodiment of the present invention wherein like reference numbers represent like elements on corresponding views.

Figure 1:
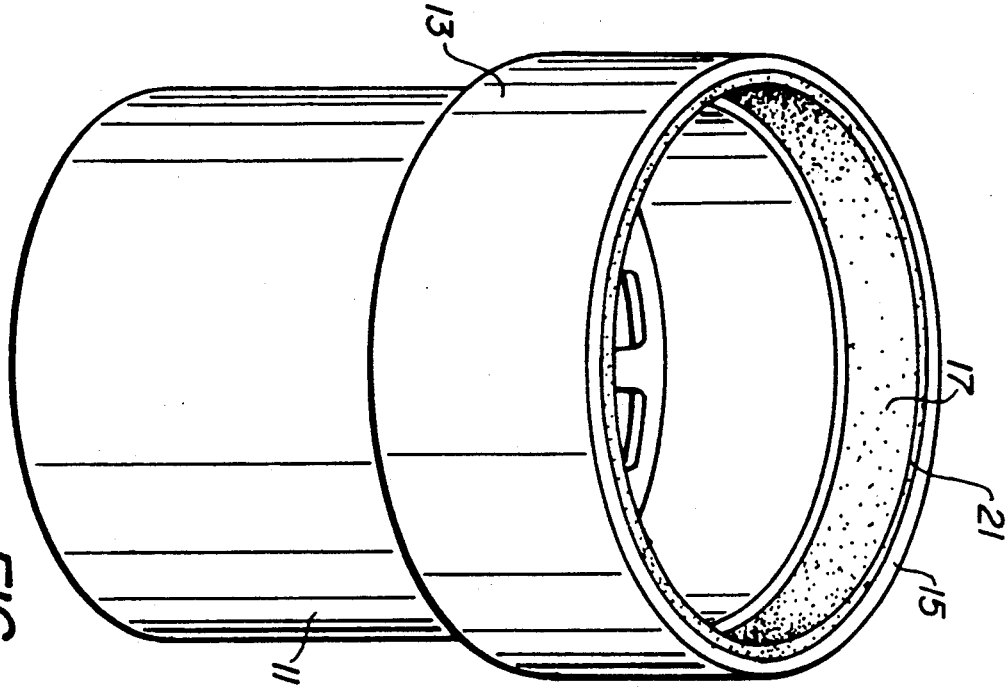
FIG. 1 is a perspective view of the golf cup of the present invention.
Figure 3:
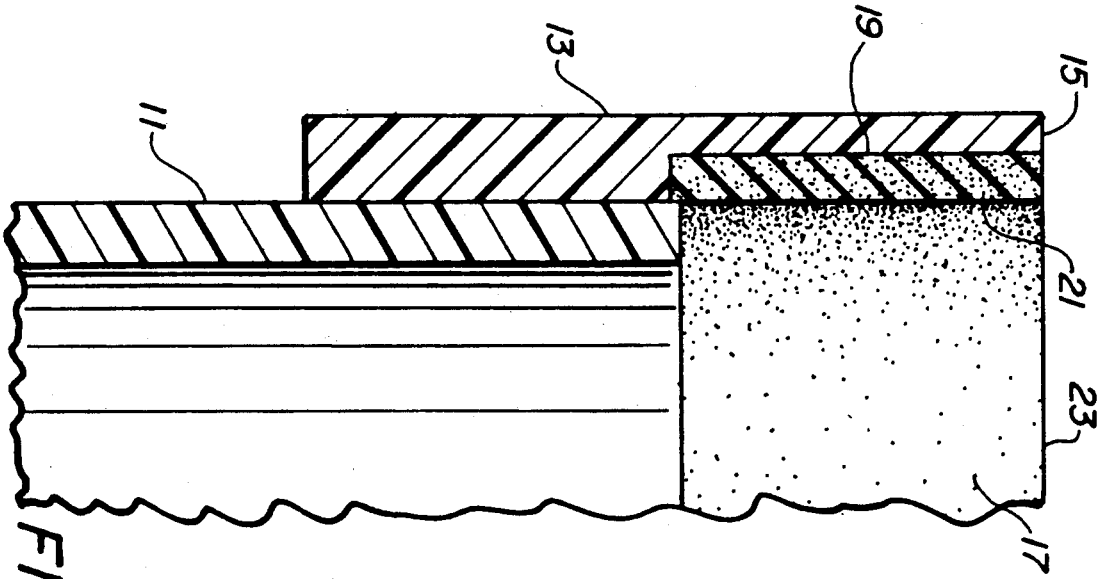
FIG. 3 is a broken out partial cross section in side elevation showing the top end of the cup assembly.
Figure 2:
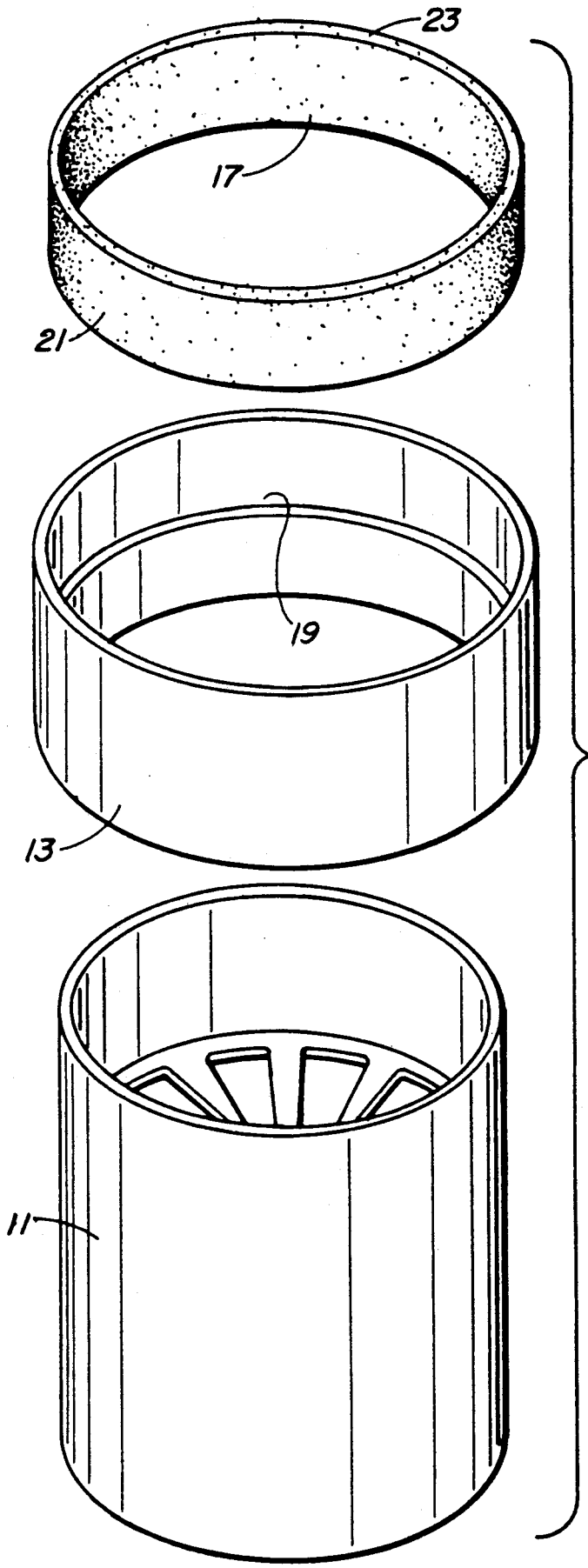
FIG. 2 is an exploded perspective view of the golf cup of the present invention.

The golf cup of the present invention is specifically adapted and designed for use with artificial golf greens, and particularly, in sand/granulate filled turf which is designed to simulate a real bent grass golf green. Reference is made to FIG. 2 of the drawings which illustrates the various parts of the present invention disassembled for clarity. It includes a golf cup base 11 which is a standard unit as used with real grass greens which is designed to be disposed at the bottom of a hole in the golf green. The cup is recessed in the hole whereby the sidewalls in the hole above the cup are bare earth up to the root system of the grass.

A cylindrical adapter ring 13 is provided which is secured by adhesive or a force fit to the upper end 15 of the external cylindrical surface of the cup 11. The adapter ring is in effect an extension member which essentially raises the height of the top of the cup whereby the top edge can be disposed proximate to the level of the base dressing in the artificial turf and provide an internal surface 17 disposed at the upper end thereof which simulates a real earth and grass interface. The artificial turf usually has carpet fibers which project upwards a short distance through and beyond the sand/granulate base dressing. The golf cup insert of the present invention is designed to have its top edge recessed in the golf hole to a level about equal to the level of the base dressing which is disposed in the carpet among the fibers.

The ring member 13 can be made out of the same material as the cup 11, which in the usual case is ABS, whereby the ring member can be secured to the cup base by liquid adhesive. It can also be made from other materials such as cast nylon tubular bar so that it can be machined for an accurate or force fit on the cup. The internal diameter of the ring member is approximately the same diameter as the external diameter of the cup with the adapter internal diameter being adjusted to accommodate the method of attachment of the ring member to the upper end of the cup. The upper end of the ring member is formed with a cylindrical recess 19 having an internal diameter which allows a compressible rubberized substance layer 21 to be disposed therein whereby the internal surface of the layer is concentric with the outer diameter of the cup. The layer forms the inner surface 17 of the upper end of the cup insert and has the diameter of a standard golf cup hole which is 4.25 inches. The cup extension ring member is 2 inches long in the preferred embodiment to provide a stable sleeve for attachment of the ring adapter to the standard golf cup.

The adapter ring 13 forms a holder for a slightly compressible rubberized substance 17 which is secured to the upper internal end of the ring member and covers or extends for a portion of the length of the internal surface from the upper end thereof. This extension ring or holder places the top end 23 of the compressible layer just below the surface opening in the simulated green whereby golf balls that are stroked into the cup will bounce against this compressible surface to replicate the play of a golf hole in a real bent grass green.

Rolling golf balls have a spin which tends to make the ball climb the opposite wall of the hole from the side of the hole from which it enters and thereby jump out of the hole if the ball contacts the far wall with a fair amount of velocity. A golf ball has even greater surface velocity caused by the spin which is more than one and one-half times the directional velocity. When the outer surface of the ball contacts the far wall of the hole, any friction between the wall and the ball skin tends to lift the ball due to the surface speed of the ball. The inserted layer of the present invention closely approximates the frictional contact between a golf ball and the grass and root transition area of a real grass golf hole. In the preferred embodiment of the present invention, a cylindrical layer of the compressible substance extends downward for approximately one inch around the internal surface from the top of the cup when the adapter ring is attached to the cup.

The slightly compressible cylindrical layer substance 17 disposed in the ring adapter is comprised of a high-density polyurethane material approximately one-eighth inch thick secured to the internal surface of the cup. In particular, the layer is a cellular, high-density, polyurethane tape, called a foam tape, produced by Norton Company Performance Plastics as V-2100 that is used as a spacer for joint dimension control in structural silicone glazing systems. It is supplied with a pressure sensitive adhesive on one side. The foam tape has a semi-rigid open cell structure with a density of 28 lbs. per cu. ft. and a Shore A hardness of 30. It requires a force of 10 psi for 10 percent compression; has a tensile strength of 180 psi; elongation property of 200 percent; dynamic tensile adhesion of 60 psi (15 minute dwell); dynamic shear adhesion of 40 psi (15 minute dwell); and a static shear adhesion of 2000 hours plus at 1 psi.

The particular material utilized as the compressible substance in the present invention was determined by extensive trial and error from many different types of approaches to providing the true bounce to the internal surface of a golf green cup.

Thus, it will be apparent from the foregoing description of the invention, in its preferred form, that it will fulfill all the objects and advantages attributable thereto. While it is illustrated and described in considerable detail herein, the invention is not to be limited to such details as have been set forth except as may be necessitated by the appended claims.

I claim:

1. A golf cup for an artificial golf green comprising a golf cup insert for a golf green hole, said insert being essentially a hollow cylinder with at least a partially closed bottom to catch golf balls, said insert having, a cylindrical layer of a compressible rubberized substance, secured to the upper internal end thereof extending for a portion of the length of the internal surface of said insert, said cylindrical layer having an internal diameter equal to the internal diameter of a standard golf green hole and being slightly compressible by putted golf ball.

2. The golf cup of claim 1 wherein said cylindrical layer is comprised of a high-density polyurethane foam tape approximately one-eighth inch thick which is secured to the internal surface of the cup by adhesive and extends for approximately one inch along the internal surface from the top of the cup.

3. A golf cup for an artificial golf green comprising a standard golf cup formed for insertion in the bottom of a standard golf green hole disposed with its upper end located at a position approximately one inch below the golf green surface, said cup having a cylindrical upper end with an external diameter equal to the internal diameter of a standard golf hole, a cylindrical ring extension adapter formed for being secured to the top of said golf cup, said ring adapter having a cylindrical layer of a compressible rubberized substance secured to the internal upper end thereof extending from the top end thereof, for approximately one inch along the length of the internal surface of said adapter, said layer having an internal diameter equal to the internal diameter of a standard golf green hole and being slightly compressible by a putted golf ball said ring adapter formed for attachment to the external surface of the upper end of said standard golf cup.

4. The golf cup of claim 3 wherein said cylindrical layer is a high density polyurethane foam tape approximately one-eighth inch thick which is secured to said ring adapter with adhesive.

* * * * *